US005662038A

United States Patent [19]

Schaum et al.

[11] Patent Number: 5,662,038

[45] Date of Patent: Sep. 2, 1997

[54] CONTROL DEVICE FOR A NUMBERING AND IMPRINTING UNIT OF A ROTARY PRINTING PRESS

[75] Inventors: Frank Schaum, Heidelberg; Willi Becker, Bammental; Jürgen Rautert, Heidelberg, all of Germany

[73] Assignee: Heidelberger Druckmaschinen Aktiengesellschaft, Heidelberg, Germany

[21] Appl. No.: 639,222

[22] Filed: Apr. 26, 1996

[30] Foreign Application Priority Data

Apr. 29, 1995 [DE] Germany ..... 195 15 847.4

[51] Int. Cl.[6] ..... B41L 49/02

[52] U.S. Cl. ..... 101/76; 101/349.1

[58] Field of Search ..... 101/45, 76, 77, 101/349, 216, 218, 219, 247

[56] References Cited

U.S. PATENT DOCUMENTS

| | | | |
|---|---|---|---|
| 3,774,535 | 11/1973 | Crissy | 101/232 |
| 3,985,073 | 10/1976 | Keller | 101/76 |
| 4,024,812 | 5/1977 | Jahn . | |
| 4,068,582 | 1/1978 | Poitras et al. | 101/76 |
| 4,306,496 | 12/1981 | Charbonneau | 101/76 |
| 4,411,194 | 10/1983 | Davidson, Jr. | 101/216 |
| 4,426,929 | 1/1984 | Fujisawa et al. | 101/76 |
| 4,470,349 | 9/1984 | Godlewski | 101/76 |
| 4,538,513 | 9/1985 | Sedlak | 101/218 |

FOREIGN PATENT DOCUMENTS

| | | |
|---|---|---|
| 2221343 | 11/1973 | Germany . |
| 2723103 | 11/1978 | Germany . |
| 1564556 | 4/1980 | United Kingdom . |

*Primary Examiner*—Eugene H. Eickholt

*Attorney, Agent, or Firm*—Nils H. Ljungman and Associates

[57] ABSTRACT

A control device for a numbering and imprinting unit of a rotary printing press is taught. The unit has a numbering cylinder removably mounted in the printing press side frames and is engageable, via eccentric bearings, at an impression cylinder. The unit has an inking unit for inking printing elements disposed on the numbering cylinder. The inking unit is designed as a removable unit. The control device has a control shaft and switching elements for engaging and disengaging respectively the numbering cylinder, for switching numbering units, and for adjusting the respective paper thickness to be processed, with the individual switching operations on the numbering and imprinting unit being optimized and effected independently of the offset printing machine.

20 Claims, 7 Drawing Sheets

CONTROL DEVICE FOR A NUMBERING AND IMPRINTING UNIT OF A ROTARY PRINTING PRESS

BACKGROUND OF THE INVENTION

1. Field of the Invention

The invention relates to a control device for a numbering and imprinting unit of a rotary printing press or machine. The numbering and printing unit has a numbering cylinder removably mounted in the printing press side frames, and the numbering cylinder is engageable, via eccentric bearings, at an impression cylinder. The numbering and printing unit has an inking unit for inking printing elements disposed on the numbering cylinder. The inking unit is designed as a removable unit. There are a control shaft and switching elements for engaging and disengaging the numbering cylinder, switching the numbering units, and adjusting the respective paper thickness to be processed.

The numbering cylinder of a printing press allows the printing of successive numbers or characters on successive paper sheets of a print job.

2. Background Information

Such a numbering and imprinting unit is known from German Patent No. 22 21 343 B2, which corresponds to U.S. Pat. No. 4,024,812. According to this known embodiment the object is achieved in that the numbering and imprinting unit is designed such that it can be removed without requiring any supporting devices or the like. For this purpose bearing and driving members are firmly disposed in the machine side frames so that merely the numbering cylinder and the inking unit may be removed from the machine.

According to a further known embodiment German Patent No. 27 23 103 B2, which corresponds to Great Britain Patent No. 1 564 556, a numbering unit is improved in that in view of a great printing performance short switching times and short switching distances are attained, with the numbering units being switched exactly.

OBJECT OF THE INVENTION

Proceeding from this state of the art it is the object of the present invention to optimize individual switching operations on the numbering and imprinting unit and to permit a control of the switching elements independently of the offset printing machine.

SUMMARY OF THE INVENTION

According to the invention this object is achieved in that, as a switching element for engagement and disengagement respectively, a cylinder supplied with a pressure medium is assigned to an eccentric bearing of the numbering cylinder, that the two eccentric bearings are connected to each other via a synchronous shaft, levers and connecting rods, that a roll engageable at an adjustable stop is provided on an eccentric bearing, and that the control shaft is mounted with both ends thereof in eccentric bearing sleeves connected, via levers, to the eccentric bearings and causing the switching elements switching the numbering units to follow the numbering cylinder when effecting impression on and adjusting the paper thickness. The advantage of this solution is that by means of a cylinder supplied with a pressure medium and a synchronous shaft both eccentric bearings may be moved for impression on/off, that one adjustable stop suffices for impression on and adjustment of paper thickness, and that with respect to all functions to be set the control shaft is caused to follow a respective adjustment of the numbering cylinder so that, with the numbering cylinder being in any position, the starting position of the individual switching elements is always identical.

That is, according to the invention this object is achieved in that, an actuating cylinder supplied with a pressure medium is used as a switching element for the engagement and disengagement of the numbering cylinder with respect to an impression cylinder. The numbering cylinder is mounted in two eccentric bearings. The actuating cylinder is connected to one of the eccentric bearings of the numbering cylinder. The eccentric bearings are connected to each other via a synchronous shaft, levers and connecting rods, so that the switching displacement of the actuator is transmitted to the second eccentric bearing. A fixed roller shaped stop is provided on one of the eccentric bearings, so that the roller stop is engageable at an adjustable stop provided on the frame of the printing press. So that numbering units on the numbering cylinder can be switched among successive numbers, there are number switching elements mounted 6n a control shaft. The control shaft is mounted with both ends thereof in eccentric bearing sleeves. The eccentric bearing sleeves of the control shaft are connected, via levers, to the eccentric bearings of the numbering cylinder, which causes the control shaft to track with the numbering cylinder, so that the number switching elements follow the numbering cylinder when the number cylinder moves between engagement with and disengagement from the impression cylinder and when the adjustable stop is adjusted for paper thickness. The advantage of this solution was discussed in the previous paragraph.

An advantageous embodiment of the invention is characterized in that the synchronous shaft is mounted with both ends thereof in machine side frames, and that one end features a bearing designed as a sliding-type bearing which may be displaced via an adjusting spindle such that on said end the eccentric bearing of the numbering cylinder is rotated slightly, thus skewing said numbering cylinder. This permits the adjustment of exact corrections, for example, when being used as an imprinting unit or for perforating purposes, so that even corrections with respect to a misaligned printed sheet may be effected.

That is, the synchronous shaft (the synchronous shaft connects the eccentric bearings of the numbering cylinder to one another as discussed above) is mounted with both ends thereof in the printing press side frames. One end of the synchronous shaft is mounted in a bearing designed as a sliding-type bearing which may be displaced via an adjusting spindle. The displacement of the one end of the synchronous shaft causes one of the eccentric bearings of the numbering cylinder to rotate slightly, thus skewing the numbering cylinder. This permits the adjustment of exact corrections as discussed in the previous paragraph.

A further advantageous embodiment is characterized in that, via a thread, the adjusting spindle is mounted in the machine side frame and, via a further thread having an opposite pitch direction, in the sliding-type bearing, and in that it is limited to one rotation by means of a stop, thus easily permitting a manual adjustment attaining a great adjusting distance and still limiting the skewed position of the numbering cylinder so that, in practice, no interferences may occur.

That is, one end of the adjusting spindle is mounted on the printing press side frame by a threaded screw member, and the other end of the adjusting spindle is mounted in the sliding-type bearing via an additional threaded member. The two threaded members have opposite pitch direction so that the position of the sliding-type bearing is adjusted by rotation of the adjusting spindle. A stop limits the spindle to one rotation. Thus, the spindle permits easy manual adjustment attaining an adequate adjusting distance, but the stop limits the adjustment of the skewed position of the numbering cylinder so that, in practice, an over adjustment can not occur, which over adjustment can interfere with the operation of the numbering cylinder.

A further feature of an embodiment is characterized in that the stop for the eccentric bearing of the numbering cylinder is provided on the shorter end of a lever pivot-mounted on the machine side frame, and in that an adjusting screw with a handwheel acts on the longer lever arm also mounted on the machine side frame. This results in a great translation of the switching forces so that even blows occurring at high operating speed may be compensated for.

In order to effect a remote-control of the individual control operations on the numbering and imprinting unit, irrespective of the printing machine, a further advantageous embodiment of the invention provides that the control shaft may be rotated by means of a cylinder supplied with a pressure medium and a lever, and that the lever features an adjusting screw adjusting the switching elements switching the numbering units, with the contact surface for a respective adjusting screw extending parallel to the tangent of the eccentric track of the respective bearing sleeve.

That is, as discussed earlier the number switching elements are mounted on the control shaft. Rotation of the control shaft moves the number switching elements between a position for switching the numbers on the numbering units (the numbering units are mounted on the numbering cylinder) and a position from which the number units are not switched. The control shaft is mounted with both ends thereof in eccentric bearing sleeves. The invention provides that the control shaft may be rotated by an actuation cylinder supplied with a pressure medium. The actuation cylinder moves a lever, which lever is connected to the control shaft. The lever features an adjusting screw for adjusting the position of the number switching elements. The adjusting screw comes in contact with a contact surface thereby limiting the rotation of the control shaft. So that the position of the number switching elements moves precisely with the numbering cylinder, upon rotation of the eccentric bearings, the contact surface extends parallel to the tangent of the eccentric track of the respective eccentric bearing sleeve of the control shaft.

This embodiment achieves short switching times irrespective of the respective position of the numbering cylinder so that the position of the switching elements once set with respect to the individual numbering units are not changed when adjusting the numbering cylinder.

That is, once the number switching elements are positioned with respect to the numbering cylinder, the number switching elements maintain their position with respect to the numbering cylinder even when the numbering cylinder is moved, such as adjustments to accommodate different paper thicknesses and engagement and disengagement of the numbering cylinder with respect to the impression cylinder. Therefore, the position of the number switching elements is independent of movement of and adjustments to the numbering cylinder.

In addition, the actuation cylinders, of which one actuation cylinder is used to move the numbering cylinder between the engaged position and the disengaged position and another actuation cylinder is used to move the number switching elements between a switching position and a non-switching position, can be switched via the pressure medium independent of the mechanism of the other printing press mechanisms and processes.

One feature of the invention resides broadly in a numbering and imprinting unit of a rotary printing press having a control device, the numbering and imprinting unit comprising: a numbering cylinder; the numbering cylinder comprising a first end and a second end; at least one number printing element being disposed on the numbering cylinder; the at least one number printing element comprising element for printing successive numbers; an inking unit; the inking unit comprising element for inking the at least one printing element; the inking unit comprising element for being removable from a printing machine; element for removably mounting the numbering cylinder in a printing machine side frames; the numbering cylinder mounting element comprising element for moving the numbering cylinder between a position engaging the impression cylinder and a position disengaging the impression cylinder; the element for moving the numbering cylinder comprising: a first eccentric bearing disposed on the first end of the numbering cylinder; a second eccentric bearing disposed on the second end of the numbering cylinder; element for rotating the first eccentric bearing; element for rotating the second eccentric bearing essentially identically to the first eccentric bearing; element for adjusting the position engaging the impression cylinder; element for switching the element for printing successive numbers among successive numbers; and element for moving the element for switching with the numbering cylinder.

Another feature of the invention resides broadly in a numbering and imprinting unit of a rotary printing press having a control device, the numbering and imprinting unit comprising: a numbering cylinder; the numbering cylinder comprising a first end and a second end; at least one number printing element being disposed on the numbering cylinder; the at least one number printing element comprising element for printing successive numbers; element for mounting the numbering cylinder in a printing press side frames; the numbering cylinder mounting element comprising element for moving the numbering cylinder between a position engaging the impression cylinder and a position disengaging the impression cylinder; the element for moving the numbering cylinder comprising: a first eccentric bearing disposed on the first end of the numbering cylinder; a second eccentric bearing disposed on the second end of the numbering cylinder; element for rotating the first eccentric bearing; element for rotating the second eccentric bearing substantially identically to the first eccentric bearing; element for adjusting the position engaging the impression cylinder; element for switching the element for printing successive numbers among successive numbers; and element for maintaining the number switching element in a substantially constant position relative to the numbering cylinder.

The above discussed embodiments of the present invention will be described further hereinbelow with reference to the accompanying figures. When the word "invention" is used in this specification, the word "invention" includes "inventions" that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

A specimen embodiment of the invention is schematically illustrated in the drawings.

DESCRIPTION OF THE PREFERRED EMBODIMENT

Figure 1:
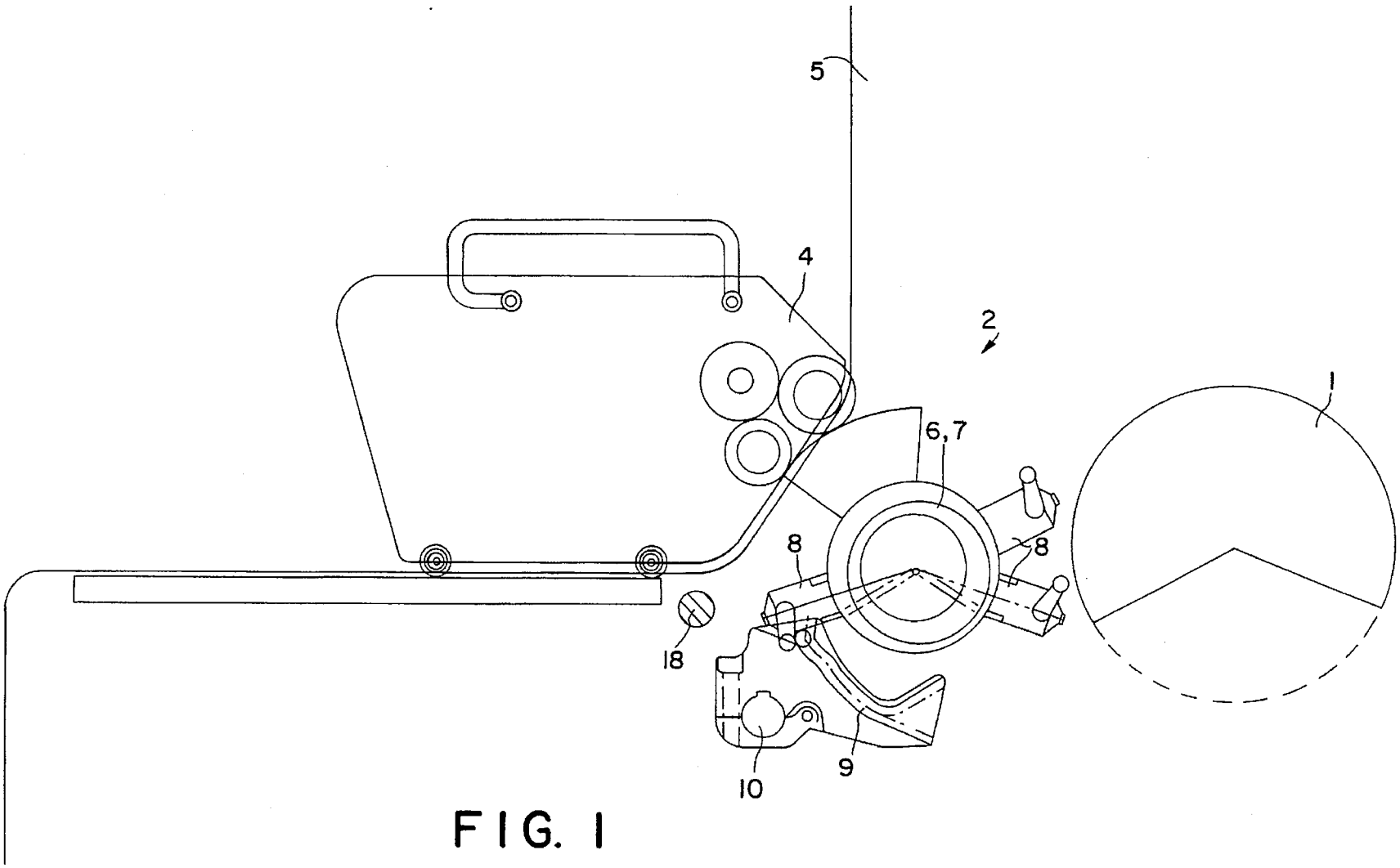
FIG. 1 is a schematic side elevational view of a numbering and imprinting unit.
Figure 5:
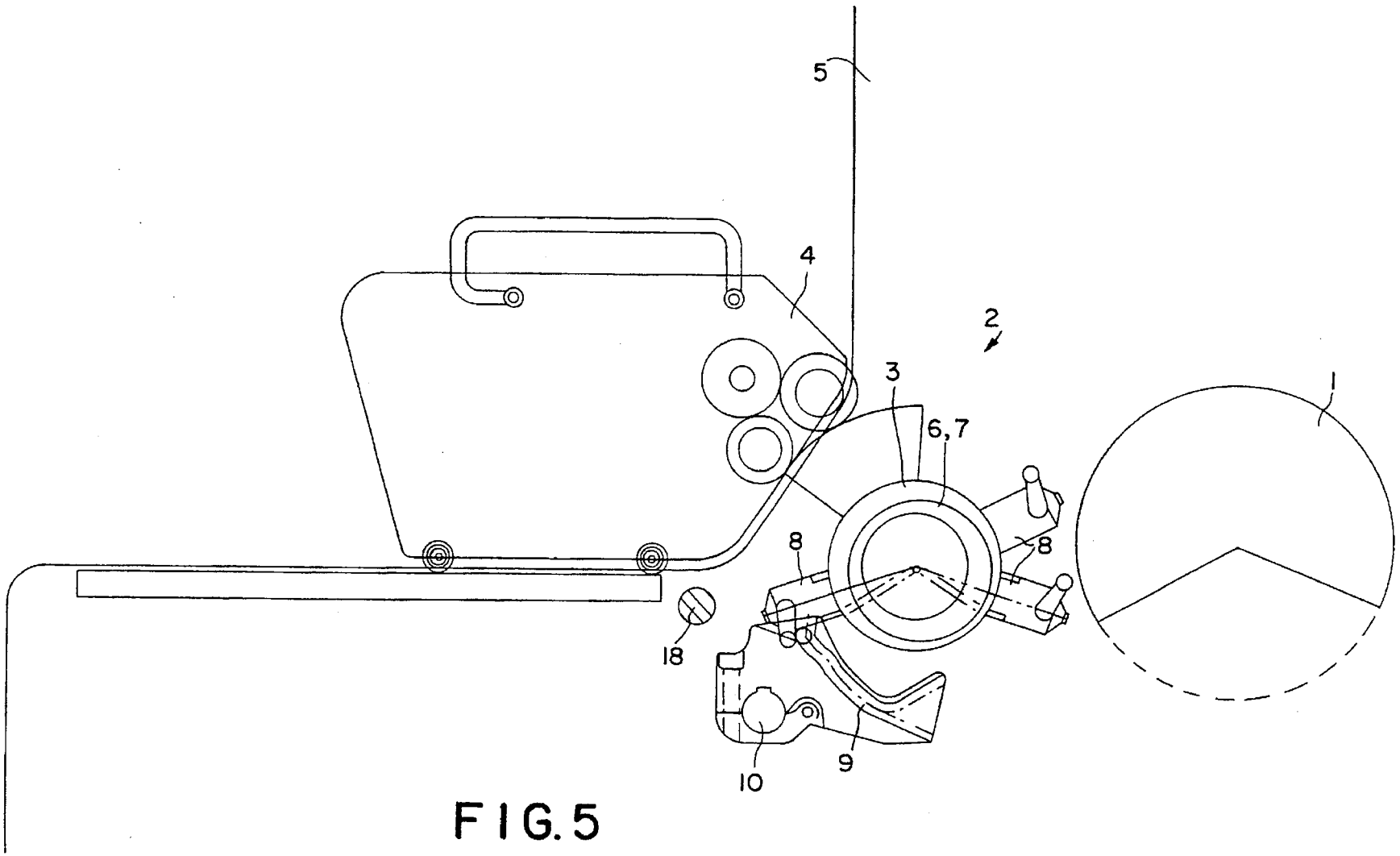
FIG. 5 is similar to FIG. 1 but shows additional components.

FIG. 1 shows an impression cylinder 1 to which a numbering and imprinting unit 2 is assigned. The numbering and imprinting unit 2 consists of a numbering cylinder 3 (see FIG. 5) removably mounted in the printing machine side frames 5. Furthermore, an inking unit 4 for inking printing elements disposed on the numbering cylinder 3 is assigned to the numbering cylinder 3. The inking unit 4 is designed as a removable unit and may be removed from the printing machine by the person operating the printing machine.

The numbering cylinder 3 is mounted with both ends thereof in eccentric bearings 6, 7 provided in machine side frames 5 and may be engaged at the impression cylinder 1 and disengaged therefrom respectively by means of the eccentric bearings 6, 7. The numbering units 8 which may be disposed on the numbering cylinder 3 are switched via control cams 9 which control cams 9, in turn, are fastened to a control shaft 10 so as to be axially displaceable. The numbering units 8, too, may be arbitrarily arranged and fastened to the shaft 11 (shown in FIG. 4) of the numbering cylinder 3.

To elaborate further, the numbering cylinder 3 is mounted on eccentric bearings 6, 7, so that when rotation occurs about eccentric bearings 6, 7 the rotational axis of the numbering cylinder 3 is moved with respect to impression cylinder 1 (the rotational axis of numbering cylinder 3 is actually moved, this movement is not referring to rotation of numbering cylinder 3 about the rotational axis). Thus, by way of appropriate rotation about eccentric bearings 6, 7, the numbering cylinder 3 can be moved closer to impression cylinder 1, so that numbering cylinder 3 engages the impression cylinder 1 and the numbering units 8 can print a number on paper carried on the impression cylinder 1. Alternatively, rotation about eccentric bearings 6, 7 in the opposite direction moves the numbering cylinder 3 away from the impression cylinder 1, so that the number units 8 of numbering cylinder 3 do not contact the impression cylinder 1.

A further explanation of the control cam 9 is presented here. Numbering and imprinting unit 2 can be used to number successive sheets of a print job with successive numbers, so that the numbers printed on the sheets are possibly increasing or decreasing, for example. As the number unit 8 rotates with numbering cylinder 3, the numbering unit 8 is engaged by control cam 9, so that the number transferred by the numbering unit 8 to the paper on impression cylinder 1 is changed to the next desired number each time numbering unit 8 engages control cam 9. In a common application each rotation of numbering cylinder 3 will change numbering unit 8 to the next number to be printed. Depending on the print job, more than one numbering unit 8 is often used.

Figure 2:
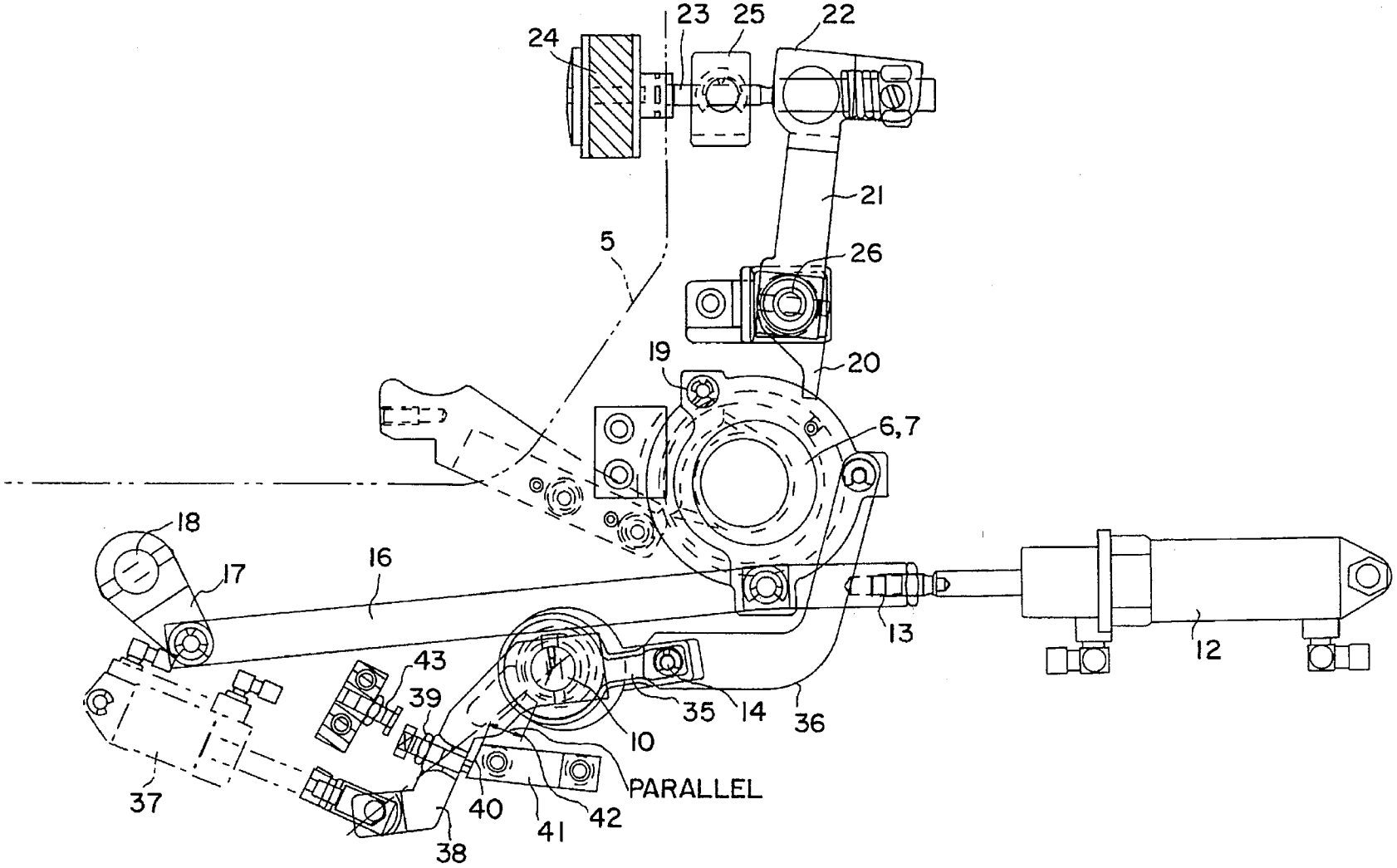
FIG. 2 shows switching elements adjusting the numbering cylinder and the numbering units respectively.

Referring to FIG. 2, an actuating cylinder 12 supplied with a pressure medium is assigned to an eccentric bearing 6 of the numbering cylinder 3. The cylinder 12 acts on said eccentric bearing 6 via a connecting rod 13 and a bolt 14, with the cylinder 12 being supported on the machine side frame 5 via a journal 15 (shown in FIG. 4). In addition, the adjusting force of the cylinder 12 is transmitted, via a connecting member 16 and a lever 17, onto a synchronous shaft 18 mounted with both ends thereof in the machine side frames 5. On the opposite machine side (see FIG. 4) a similar lever 17 is also secured on the synchronous shaft 18, which lever 17 transmits the adjusting force, via a similar connecting member 16, onto the eccentric bearing 7 so that both eccentric bearings 6, 7 may be rotated simultaneously and synchronously. Using only one actuating cylinder 12 supplied with a pressure medium, and irrespective of the machine control, an exact engagement at the impression cylinder 1 and an exact disengagement therefrom respectively is permitted.

To reiterate the actuating cylinder 12 is connected to eccentric bearings 6, 7 via connecting rod 13, bolt 14, connecting members 16, levers 7, and synchronous shaft 18, so that eccentric bearings 6 and 7 are rotated simultaneously. The simultaneous rotation of eccentric bearings 6 and 7 moves both ends of numbering cylinder 3 either closer to or further from impression cylinder 1, so that numbering cylinder 3 can be engaged with and disengaged from impression cylinder 1 with precision.

In the position "impression on" the eccentric bearings 6, 7 are rotated clockwise until a roll or roller 19 provided on the eccentric bearing 6 may be engaged at a stop 20. The stop 20 is provided on the shorter end of a lever 21 pivot mounted on the machine side frame 5, an adjusting screw 23 with a handwheel 24 acting on the longer lever arm 22, with the adjusting screw 23 extending through a supporting body 25 fastened to the machine side frame 5. Via the handwheel 24 the stop 20 and thus the two eccentric bearings 6, 7 may be changed with respect to their path of rotation so that with respect to the impression cylinder 1 the numbering cylinder 3 may be adjusted to different paper thicknesses. Via a stud 26 the lever 21 is also mounted on the machine side frame 5.

That is, when eccentric bearings 6, 7 are rotated clockwise (as seen in FIG. 2) numbering cylinder 3 is moved towards impression cylinder 1, so that numbering cylinder 3 engages impression cylinder 1 and a number is printed on the paper on impression cylinder 1 by numbering cylinder 3. As discussed above, lever 21 allows for the adjustment of the numbering cylinder 3 with respect to impression cylinder 1, so that different paper thicknesses carried on the impression cylinder 1 can be accommodated.

As discussed above roll or roller 19 is preferably mounted on eccentric bearing 6, but roll 19 could be mounted on eccentric bearing 7. Roll or roller 19 can be designed as a solid structure non-rotationally mounted on eccentric bearing 6 or as a sleeve which rotates about a member fixedly mounted on eccentric bearing 6.

Figure 3:
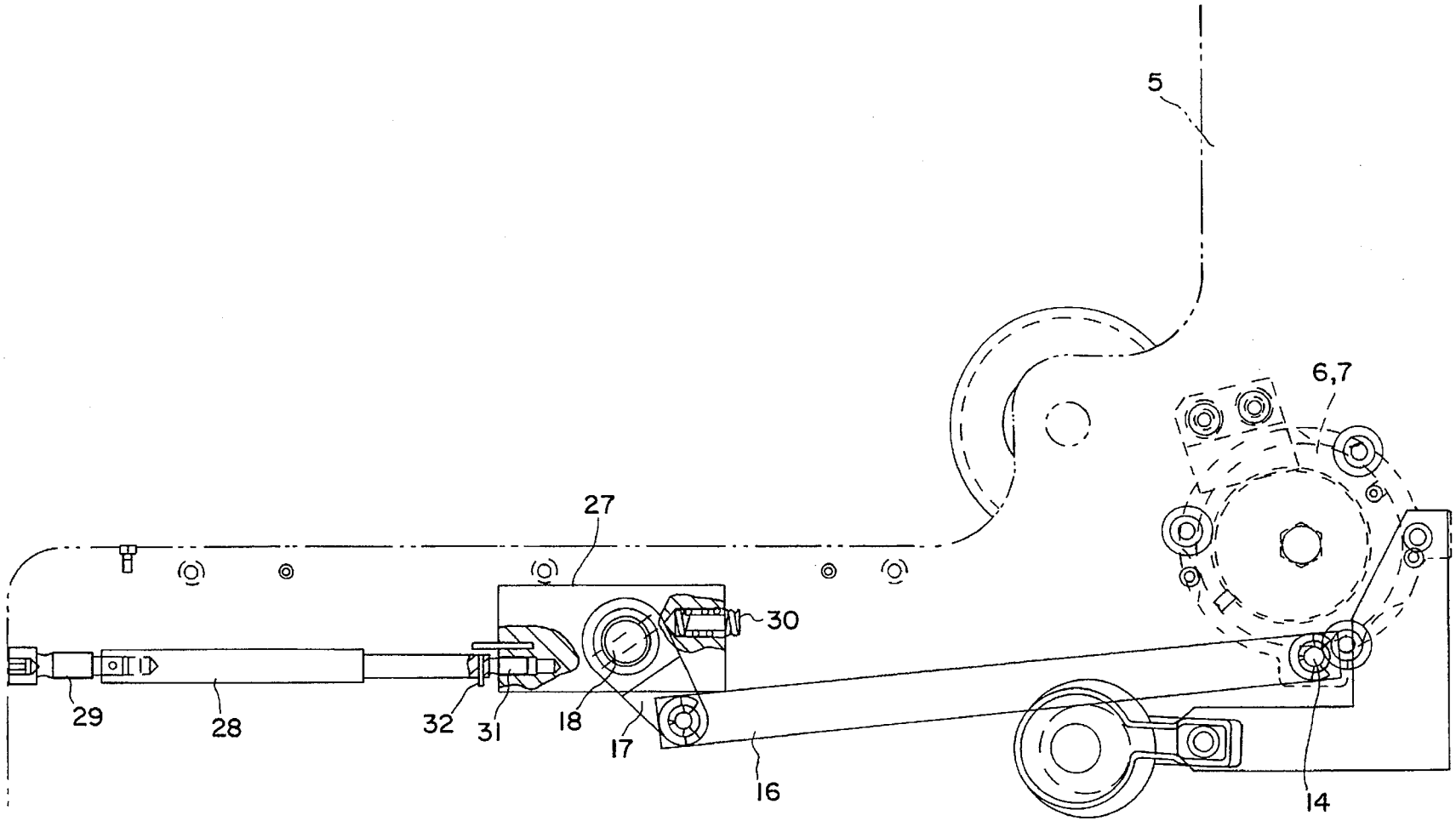
FIG. 3 shows switching elements skewing the numbering cylinder.

Referring to FIG. 3, in order to permit skewing of the numbering cylinder 3 the synchronous shaft 18 is mounted with one end thereof in a sliding-type bearing 27 provided in the machine side frame 5, which sliding-type bearing 27 is longitudinally guided in said machine side frame 5. Via an adjusting spindle 28 and a threaded pin 29 supported in a thread provided in the machine side frame 5, the sliding-type bearing 27 may be displaced in longitudinal direction against the force of a compression spring 30. Via a further thread 31, with an opposite pitch direction to the threaded pin 29, the adjusting spindle 28 acts on the sliding-type bearing 27, so that the two threads cause the sliding distance to be extended. A stop 32 limits the rotary motion of the adjusting spindle 28 to one rotation, thus permitting skewing of the numbering cylinder 3 by a few tenths of a millimeter. The skewing thus effects a slight rotation of the eccentric bearing 7.

Figure 4:
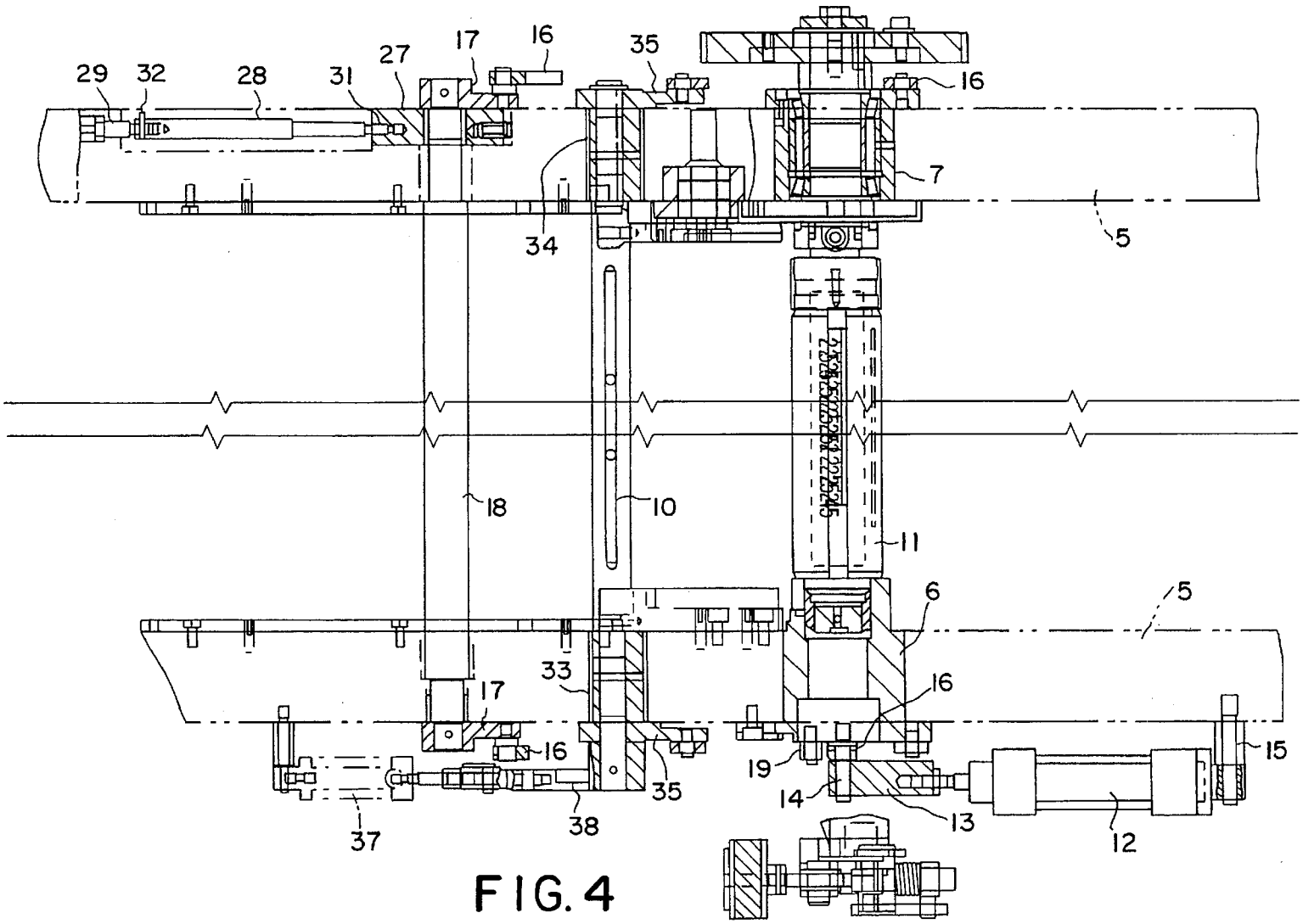
FIG. 4 is a top view of the numbering cylinder and the switching elements.

A further explanation of sliding-type bearing 27 is presented here. The longitudinal position of sliding-type bearing 27 is controlled by adjusting spindle 28. Adjusting spindle 28 is supported on the printing machine side frame 5 by threaded pin 29. The threaded pin 29 can be threaded on the end which engages adjusting spindle 28, in which case adjusting spindle 28 is also threaded to engage threaded pin 29. Thus, threaded pin 29 is non-rotationally supported by machine side frame 5, so that rotation occurs between the threaded pin 29 and the threaded portion of adjusting spindle 28, thereby moving sliding-type bearing 27. Alternatively, the threaded pin 29 can be non-rotationally connected to adjusting spindle 28, and the threads of threaded pin 29 can rotationally engage a threaded portion of machine side frame 5, which threaded portion of machine side frame 5 is non-rotationally connected to machine side frame 5, thereby moving sliding-type bearing 27. As discussed in the previous paragraph, the other end of adjusting spindle 28 acts on slide-type bearing 27 via thread 31. The thread 31 and threaded pin 29 have thread pitches in opposite directions, so that slide-type bearing 27 is moved longitudinally upon rotation of adjusting spindle 28. Referring to FIG. 4, when slide-type bearing 27 is moved, the end of synchronous shaft 18 mounted on slide-type bearing 27 is also moved longitudinally. As shown in FIG. 4, the slide-type bearing 27 and the eccentric bearing 7 are located on the same printing machine side frame 5. Thus, when the end of synchronous shaft 18 is moved longitudinally, the adjacent lever 17 is moved, thereby causing movement of connecting member 16, which movement of connecting member 16 rotates eccentric bearing 7. Thus, eccentric bearing 7 can be rotated very slightly without rotating eccentric bearing 6, thereby moving only one end of numbering cylinder 3, the end supported by eccentric bearing. 7, closer to or further away from impression cylinder 1, so that the numbering cylinder 3 can be skewed very slightly with respect to impression cylinder 1. This allows slight adjustments to be made in the alignment of numbering cylinder 3 with respect to impression cylinder 1.

In an alternative embodiment, the slide-type bearing 27 can be mounted on the opposite printing machine side frame 5 from eccentric bearing 7. Thus, when the end of synchronous shaft 18 is moved longitudinally, lever 17 is moved, thereby causing a corresponding rotation of synchronous shaft 18. On the opposite side of the printing machine the rotation of synchronous shaft 18 will move the opposite lever 17 and connecting arm 16, so that eccentric bearing 7 is rotated slightly. Thus, eccentric bearing 7 can be rotated very slightly without rotating eccentric bearing 6, as was described above.

Referring to FIGS. 2 and 4, the control shaft 10, too, is mounted with both ends thereof in eccentric bearing sleeves 33, 34 (see FIG. 4) provided in the machine side frames 5. Levers 35 are provided on eccentric bearing sleeves 33, 34, which levers 35 are connected, via a connecting member 36, to the eccentric bearings 6, 7. This ensures that the control cams 9 provided on the control shaft 10 are always positioned essentially identically, given any position of the numbering cylinder 3.

That is, the eccentric bearing sleeve 33 is connected by a first lever 35 to eccentric bearing 6, and the eccentric bearing sleeve 34 is connected by a second lever 35 to eccentric bearing 7. Thus, when eccentric bearings 6 and 7 are rotated, the levers 35 rotate eccentric bearing sleeves 33 and 34, so that the position of the rotational axis of control shaft 10 follows the position of the rotational axis of numbering cylinder 3. The control cams 9 provided on the control shaft 10 also follow the position of the rotational axis of numbering cylinder 3. To emphasize, rotation of the eccentric bearing sleeves 33, 34 and eccentric bearings 6, 7 does not rotate the respective shaft or cylinder about an axis but rather moves or translates the axis of the respective shaft or cylinder, so that there is translational motion of the shaft or cylinder.

The distinction between eccentric bearing sleeves and eccentric bearings is arbitrary. One sleeve of each of the eccentric bearings 33, 34, 6, 7 is mounted on the machine side frame 5. Each eccentric bearing has a second sleeve on which the respective shaft or cylinder is mounted eccentrically. Thus rotation of the second sleeve translates the shaft or cylinder mounted thereon as discussed above. This second sleeve, which is connected to the shaft or cylinder, is also the sleeve which generally moves under the influence of a lever or control member.

To switch the control cams 9 the control shaft 10 is rotated by an actuation cylinder 37 (FIGS. 2 and 4) supplied with a pressure medium and a lever 38 such that, when rotating the numbering cylinder 3, the control cams 9 are switched further or switched off. Both positions may be exactly adjusted by means of an adjusting screw 39 (see FIG. 2) provided on lever 38. In order not to cause any change in the adjustment of the adjusting screw 39, with the control shaft 10 following the control cam 9, the contact surface 40 extends parallel to the tangent 42 of the eccentric path of a respective eccentric bearing sleeve 33, 34. The contact surface 40 is provided on a stop 41 fastened to the machine side frame 5. When engaging the numbering units 8 the lever 38 can be pivoted clockwise by the cylinder 37 so that the adjusting screw 39 abuts against a second stop 43.

In other words, the control cams 9 have an engagement position, which engagement position permits the control cams 9 to switch or trigger the numbering units 8, as numbering units 8 rotate on numbering cylinder. 3. The control cams 9 also have a disengaged or off position, in which disengaged position the control cams 9 are pivoted away from numbering cylinder 3, so that the control cams 9 do not switch the numbering units 8. Rotation about control shaft 10 moves control cams 9 between the engaged position and the disengaged position. To rotate control shaft 10, an actuation cylinder 37 is connected to control shaft 10 by way of lever 38. When actuation cylinder 37 extends, lever 38 rotates control shaft 10 in a counter clockwise direction, which can move control cams 9 into the engagement position. Adjusting screw 39 on lever 38 allows for the adjustment of the engagement position and disengagement position. Stop 41 is fastened to the printing press side frame 5, which stop 41 has contact or stop surface 40. When lever 38 moves towards stop 41, the motion of lever 38 is limited by adjustment screw 39 coming in contact with contact surface 40.

Figure 7:
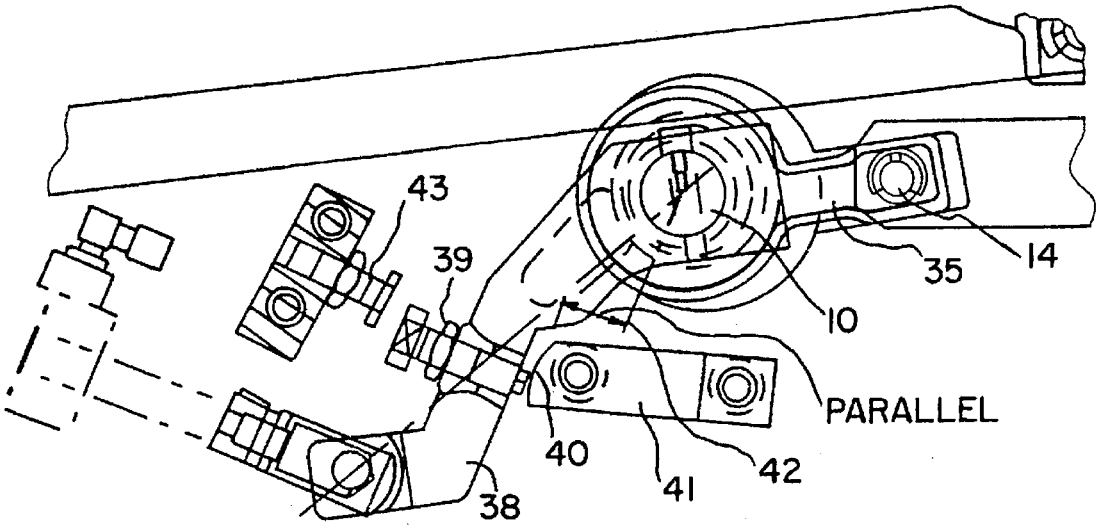
FIG. 7 shows an alternative embodiment of switching elements adjusting the numbering units.

Thus, the alignment or contour of contact surface 40 is important in maintaining the position of control cams 9 essentially constant relative to numbering cylinder 3. The actuation cylinder 37 changes the angular position of lever 38, which change in the angular position of lever 38 rotates control shaft 10, which rotation of control shaft 10 changes the angular position of control cams 9, which angular change in control cams 9 moves the ends of control cams 9 to either engage or disengage the numbering units 8. When the control cams 9 are in the engaged position it is important that the position of the control cams 9 relative to numbering cylinder 3 remain essentially constant, including when adjustments are made at the eccentric bearings 6, 7. If the angular position of lever 38 is essentially constant, then the angular position of control cams 9 will remain essentially constant. When eccentric bearings 6, 7 are rotated, connecting members 36 causes eccentric bearing sleeves 33, 34 to rotate also. The ends of control shaft 10 are mounted on eccentric bearing sleeves 33, 34, so that when eccentric bearing sleeves 33, 34 rotate, the central axis of control shaft 10 traces an arc which is limited by actuation cylinder 12 and stop 20. This arc through which control shaft 10 rotates is parallel to the path of the arc of eccentric bearing sleeves 33, 34. If the contact surface 40 is oriented parallel to the tangent 42 of the arc traced by the central axis of control shaft 10 (which arc is parallel to the eccentric path of the sleeves of bearing 33, 34, hence the tangent to the arc and the path of bearing sleeves 33, 34 is the same tangent), then the angular position of lever 38 should remain essentially constant. The small arc traced by the central axis of control shaft 10 actually has a series of tangents, but the tangent to the central point of the arc could be used as a reference to which stop surface 40 could be oriented parallel. Alternatively, the stop surface 40 could be contoured (see FIG. 7) to follow the arc traced by the central axis 0f control shaft 10, in which case, as the tangent to the arc traced by the central axis of the control shaft 10 changes the tangent to the contour of the stop surface 40 is always parallel. The contoured stop surface 40 shown in FIG. 7 is oriented essentially the same as the arc traced by the central axis of control shaft 10. Thus, the angular position of the lever 38 should remain essentially constant, so that the control cams 9 also maintain an essentially constant angle and maintain an essentially constant position relative to numbering cylinder 3.

Second stop 43 is designed as an adjusting screw, so that when control shaft 10 is rotated clockwise, the disengaged position of control cams 9 can be adjusted independently of the adjustment position of adjusting screw 39..

The actuating cylinders 12 and 37 are well known. The actuating cylinders 12 and 37 can be driven by any suitable pressure medium such as air or hydraulic fluid. The control of actuating cylinders 12 and 37 is also well known.

Figure 6:
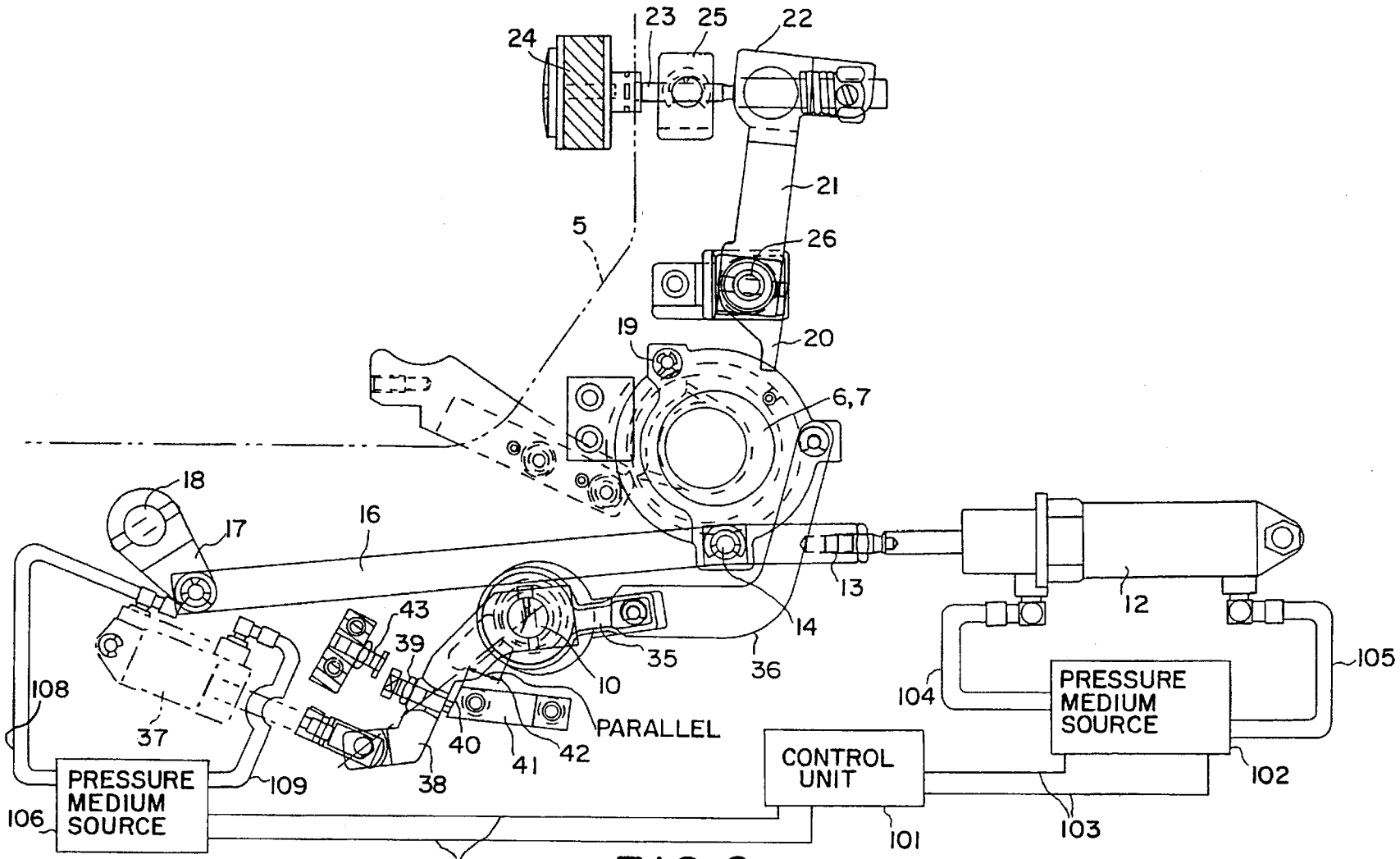
FIG. 6 is similar to FIG. 2 but also shows a control unit.

FIG. 6 shows a control unit 101. The control unit 101 controls pressure medium source 102 via signal lines 103. The pressure medium source 102 activates actuating cylinder 12 via pressure lines 104 and 105. Similarly, control unit 101 controls pressure medium source 106 via signal lines 107. The pressure medium source 106 activates actuating cylinder 37 via pressure lines 108 and 109. Control unit 101 can be operated by manual input or by preprogrammed input.

One feature of the invention resides broadly in the control device for a numbering and imprinting unit of a rotary printing machine comprising a numbering cylinder removably mounted in machine side frames and being engageable, via eccentric bearings, at an impression cylinder; comprising an inking unit inking printing elements disposed on said numbering cylinder, said inking unit being designed as a removable unit, and comprising a control shaft and switching elements engaging and disengaging respectively said numbering cylinder, switching numbering units and adjusting the respective paper thickness to be processed, characterized in that, as a switching element for engagement and disengagement respectively, a cylinder 12 supplied with a pressure medium is assigned to an eccentric bearing 6 of a numbering cylinder 3, that two eccentric bearings 6, 7 are connected to each other via a synchronous shaft 18, levers 17 and connecting rods 16, that a roll 19 engageable at an adjustable stop 20 is provided on an eccentric bearing 6, and that a control shaft 10 is mounted with both ends thereof in eccentric bearing sleeves 33, 34 connected to said eccentric bearings 6, 7 via levers 35 and causing the switching elements switching numbering units 8 to follow said numbering cylinder 3 when effecting impression on and adjusting the paper thickness.

Another feature of the invention resides broadly in the control device characterized in that the synchronous shaft 18 is mounted with both ends thereof in the machine side frames, and that a bearing provided on one end is designed as a sliding-type bearing 27 which, via an adjusting spindle 28, is displaceable such that on said end the eccentric bearing 7 of the numbering cylinder 3 is slightly rotated, thus skewing said numbering cylinder.

Yet another feature of the invention resides broadly in the control device characterized in that, via a thread 29, the adjusting spindle 28 is supported in the machine side frame 5 and, via a further thread 31 having an opposite pitch direction, it is supported in the sliding-type bearing 27, and via a stop 32 it is limited to one rotation.

Still another feature of the invention resides broadly in the control device characterized in that the stop 20 for the eccentric bearing 6 is provided on the shorter end of a lever 21 pivot-mounted on the machine side frame 5, and that an adjusting screw 23 with handwheel 24 also mounted on the machine side frame 5 acts on the longer lever arm 22.

A further feature of the invention resides broadly in the control device characterized in that the control shaft 10 may be rotated via a cylinder 37 supplied with a pressure medium and a lever 38, that an adjusting screw 39 is provided on the lever 38 to adjust the switching elements switching the numbering units 8, and that a contact surface 40 for the adjusting screw 39 extends parallel to the tangent 42 of the eccentric path of the respective bearing sleeve 33, 34.

Examples of pressure medium actuating devices and control devices for the actuating devices can possibly be found in the following U.S. Pat. No. 4,142,447 entitled "Hydraulic actuator"; U.S. Pat. No. 4,154,262 entitled "Hydraulic control system"; U.S. Pat. No. 4,164,167 entitled "Hydraulic servomechanism"; U.S. Pat. No. 4,167,891 entitled "Hydraulic actuator"; U.S. Pat. No. 4,175,914 entitled "Hydraulic stop"; U.S. Pat. No. 4,178,837 entitled "Pneumatically operated actuator and method of making the same"; U.S. Pat. No. 4,221,158 entitled "Pneumatic actuator"; U.S. Pat. No. 4,230,025 entitled "Pneumatic actuator"; U.S. Pat. No. 4,235,105 entitled "Hydraulic actuator controls"; U.S. Pat. No. 4,241,644 entitled "Pneumatic actuator"; and U.S. Pat. No. 4,252,050 entitled "Control valve unit for hydraulic actuator".

Examples of numbering and imprinting devices for printing presses can possibly be found in the following U.S. Pat. No. 4,572,069 entitled "Device for changing a numbering and imprinting device in a printing press"; U.S. Pat. No.

4,577,555 entitled "Numbering device for offset press"; U.S. Pat. No. 4,625,644 entitled "Apparatus for an offset printing press" and U.S. Pat. No. 4,353,297 entitled "Numbering printing machine for offset press".

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is All of the U.S. patents, and Great Britain patents recited herein, are hereby incorporated by reference as if set forth in their entirety herein.

The corresponding foreign patent publication application, namely, Federal Republic of Germany Patent Application No. 195 15 847.4, filed on Apr. 29, 1995, having inventors Frank Schaum, Willi Becker, and Dr. Jürgen Rautert, is hereby incorporated by reference as if set forth in its entirety herein.

The invention as described hereinabove in the context of the preferred embodiments is not be taken as limited to all of the provided details thereof, since modifications and variations thereof may be made without departing from the spirit and scope of the invention.

What is claimed is:

1. A control device for a numbering and imprinting unit of a rotary printing press, which numbering and imprinting unit comprises: a numbering cylinder removably mounted in a printing press side frames; the numbering cylinder comprising at least one number printing element for printing successive numbers; an inking unit comprising a device for inking said at least one printing element and the inking unit being removable from the printing press; said control device comprising:

an arrangement for moving a numbering cylinder between a first position where a number cylinder is in engagement with an impression cylinder and a second position where a numbering cylinder is in disengagement from an impression cylinder;

said arrangement for moving a numbering cylinder comprising:

a first eccentric bearing disposed on a first end of a numbering cylinder;

a second eccentric bearing disposed on a second end of a numbering cylinder;

a device for rotating said first eccentric bearing;

a device for rotating said second eccentric bearing with a rotation of said first eccentric bearing;

a device for adjusting the position of engagement of a numbering cylinder with an impression cylinder;

said device for rotating said first eccentric bearing comprising a pressure medium driven actuating cylinder;

a device for switching a successive number printing element disposed on a numbering cylinder among successive numbers;

an arrangement for maintaining said successive number switching device in a substantially constant position relative to a numbering cylinder;

said device for rotating said second eccentric bearing comprising:

a first shaft for rotating said second eccentric bearing with said first eccentric bearing, said first shaft comprising a first end and a second end;

a first lever non-rotationally mounted on said first end of said first shaft;

said first lever extending radially outward from said first shaft;

a first connecting member disposed to connect said first eccentric bearing to said first lever;

a second lever non-rotationally mounted on said second end of said first shaft;

said second lever extending radially outward from said first shaft; and a second connecting member disposed to connect said second eccentric bearing to said second lever;

said adjusting device comprising an adjustable stop;

said numbering cylinder moving arrangement comprising a contact surface;

said contact surface being disposed on one of said first eccentric bearing and said second eccentric bearing;

said contact surface being disposed to contact said adjustable stop in the position of engagement of a numbering cylinder with an impression cylinder; and said arrangement for maintaining said number switching device in a substantially constant position relative to said numbering cylinder comprising:

a second shaft comprising a first end and a second end;

a third eccentric bearing disposed to mount said first end of said second shaft; and a fourth eccentric bearing disposed to mount said second end of said second shaft;

a first control lever disposed to connect said first eccentric bearing to said third eccentric bearing; and a second control lever disposed to connect said second eccentric bearing to said fourth eccentric bearing.

2. The control device of claim 1, wherein:

said first shaft is rotatably mounted with said first end and said second end in a printing press side frames;

said control device comprises a device for moving a second end of a numbering cylinder independent of a first end of a numbering cylinder;

said device for moving a second end of a numbering cylinder comprises an arrangement for rotating said second eccentric bearing independent of said first eccentric bearing;

said arrangement for rotating said second eccentric bearing independently comprises:

a bearing slidably mounted on a printing press side frame;

said slidable bearing comprising an arrangement for moving in a direction towards a numbering cylinder and away from a numbering cylinder; and one of said first end and said second end of said first shaft is disposed in said slidably mounted bearing.

3. The control device of claim 1, wherein:

said control device comprises a device for moving a second end of a numbering cylinder independent of a first end of a numbering cylinder;

said device for moving a second end of a numbering cylinder comprising an arrangement for rotating said second eccentric bearing independent of said first eccentric bearing;

said arrangement for rotating said second eccentric bearing independently comprising:

a bearing slidably mounted on a printing press side frame;

said slidable bearing comprising an arrangement for moving in a direction towards a numbering cylinder and away from a numbering cylinder; and one of said first end and said second end of said first shaft is disposed in said slidably mounted bearing;

said slidable bearing moving arrangement comprises a rotatable member;

said rotatable member comprises a first end and a second end;

said first end of said rotatable member comprises a first threaded portion;

said first threaded portion has a thread pitch in a first direction;

said slidable bearing moving arrangement comprises a second threaded portion disposed on a printing press side frame;

said first threaded portion is disposed on said second threaded portion;

said second end of said rotatable member comprises a third threaded portion;

said third threaded portion has a thread pitch in a second direction;

said slidable bearing comprises a fourth threaded portion;

said third threaded portion is disposed on said fourth threaded portion;

said thread pitch first direction is opposite to said thread pitch second direction; and said rotatable member comprises a stop for limiting said rotatable member to one rotation.

4. The control device of claim 1, wherein:

said adjustable stop comprises a lever pivotally mounted on a printing press side frame;

said lever comprises a short end and a long end;

said short end is disposed to contact said contact surface disposed on one of said first eccentric bearing and said second eccentric bearing;

said contact surface comprises a roller member rotatably mounted on one of said first eccentric bearing and said second eccentric bearing;

said long end of said lever comprises a threaded member adjustably mounted on a printing press side frame, said threaded member for adjusting said lever; and said threaded member comprises a handwheel for manually adjusting said threaded member.

5. The control device of claim 1, wherein:

said control device comprises an arrangement for moving said number element switching device between an engaged position for switching a number printing element and a disengaged position;

said arrangement for moving said number switching device comprises a lever non-rotationally mounted on said second shaft;

said arrangement for moving said number switching device comprises an additional pressure medium driven actuating cylinder connected to said lever mounted on said second shaft;

said third eccentric bearing is disposed to move a numbering cylinder in an eccentric path;

said eccentric path has at least one tangent;

said arrangement for maintaining said number switching device in a substantially constant position relative to a numbering cylinder comprises:

an adjusting screw disposed on said second shaft lever;

an adjusting screw stop surface disposed on a printing press side frame; and said adjusting screw stop surface is disposed substantially parallel to the at least one tangent.

6. The control device of claim 2, wherein:

said slidable bearing moving arrangement comprises a rotatable member;

said rotatable member comprises a first end and a second end;

said first end of said rotatable member comprises a first threaded portion;

said first threaded portion has a thread pitch in a first direction;

said slidable bearing moving arrangement comprises a second threaded portion disposed on a printing press side frame;

said first threaded portion is disposed on said second threaded portion;

said second end of said rotatable member comprises a third threaded portion;

said third threaded portion has a thread pitch in a second direction;

said slidable bearing comprises a fourth threaded portion;

said third threaded portion is disposed on said fourth threaded portion;

said thread pitch first direction is opposite to said thread pitch second direction; and said rotatable member comprises a stop for limiting said rotatable member to one rotation.

7. A control device for a numbering and imprinting unit of a rotary printing press, which numbering and imprinting unit comprises: a numbering cylinder comprising a first end and a second end; at least one number printing element being disposed on the numbering cylinder; the at least one number printing element comprising a device for printing successive numbers; an inking unit for inking said at least one printing element and the inking unit being removable from a printing machine; said control device comprising:

a device for removably mounting a numbering cylinder in a printing press side frames;

said numbering cylinder mounting device comprising an arrangement for moving a numbering cylinder between a first position where a numbering cylinder is in engagement with an impression cylinder and a second position where a numbering cylinder is in disengagement from an impression cylinder;

said arrangement for moving a numbering cylinder comprising:

a first eccentric bearing disposed on a first end of a numbering cylinder;

a second eccentric bearing disposed on a second end of a numbering cylinder;

a device for rotating said first eccentric bearing;

a device for rotating said second eccentric bearing with a rotation of said first eccentric bearing; and a device for adjusting the position of engagement of a numbering cylinder with an impression cylinder;

a device for switching said successive number printing device among successive numbers; and an arrangement for maintaining said successive number switching device in a substantially constant position relative to a numbering cylinder.

8. The control device of claim 7, wherein:

said device for rotating said second eccentric bearing comprises:

a first shaft for rotating said second eccentric bearing with said first eccentric bearing, said first shaft comprising a first end and a second end;

said first shaft being rotatably mounted in a printing press side frames;

a first lever non-rotationally mounted on said first end of said first shaft;

said first lever extending radially outward from said first shaft;

a first connecting member disposed to connect said first eccentric bearing to said first lever;

a second lever non-rotationally mounted on said second end of said first shaft;

said second lever extending radially outward from said first shaft; and a second connecting member disposed to connect said second eccentric bearing to said second lever.

9. The control device of claim 8, wherein:

said adjusting device comprises an adjustable stop disposed on the printing press side frames; and said numbering cylinder moving arrangement comprises a contact surface;

said contact surface is disposed on one of said first eccentric bearing and said second eccentric bearing, said contact surface is disposed to contact said adjustable stop in said engaging position of said numbering cylinder.

10. The control device of claim 9, wherein:

said arrangement for maintaining said number switching device in a substantially constant position relative to a numbering cylinder comprises:

a second shaft comprising a first end and a second end;

a third eccentric bearing disposed to mount said first end of said second shaft in a printing press side frames; and a fourth eccentric bearing disposed to mount said second end of said second shaft in a printing press side frames;

a first control lever disposed to connect said first eccentric bearing to said third eccentric bearing; and a second control lever disposed to connect said second eccentric bearing to said fourth eccentric bearing.

11. The control device of claim 10, wherein:

said control device comprises a device for moving a second end of a numbering cylinder independent of a first end of a numbering cylinder;

said device for moving a second end of a numbering cylinder comprises an arrangement for rotating said second eccentric bearing independent of said first eccentric bearing;

said arrangement for rotating said second eccentric bearing independently comprises:

a bearing slidably mounted on a printing press side frame;

said slidable bearing comprising an arrangement for moving in a direction towards a numbering cylinder and away from a numbering cylinder; and one of said first end and said second end of said first shaft is disposed in said slidably mounted bearing.

12. The control device of claim 11, wherein:

said slidable bearing moving arrangement comprises a rotatable member;

said rotatable member comprises a first end and a second end;

said first end of said rotatable member comprises a first threaded portion;

said first threaded portion has a thread pitch in a first direction;

said slidable bearing moving arrangement comprises a second threaded portion disposed on a printing press side frame;

said first threaded portion is disposed on said second threaded portion;

said second end of said rotatable member comprises a third threaded portion;

said third threaded portion has a thread pitch in a second direction;

said slidable bearing comprises a fourth threaded portion;

said third threaded portion is disposed on said fourth threaded portion;

said thread pitch first direction is opposite to said thread pitch second direction; and said rotatable member comprises a stop for limiting said rotatable member to one rotation.

13. The control device of claim 12, wherein:

said adjustable stop comprises a lever pivotally mounted on a printing press side frame;

said lever comprises a short end and a long end;

said short end is disposed to contact said contact surface disposed on one of said first eccentric bearing and said second eccentric bearing;

said contact surface comprises a roller member rotatably mounted on one of said first eccentric bearing and said second eccentric bearing;

said long end of said lever comprises a threaded member adjustably mounted on a printing press side frame, said threaded member for adjusting said lever; and said threaded member comprises a handwheel for manually adjusting said threaded member.

14. The control device of claim 13, wherein:

said control device comprises an arrangement for moving said number element switching device between an engaged position for switching a number printing element and a disengaged position;

said arrangement for moving said number switching device comprises a lever non-rotationally mounted on said second shaft;

said third eccentric bearing is disposed to move a numbering cylinder in an eccentric path;

said eccentric path has at least one tangent;

said arrangement for maintaining said number switching device in a substantially constant position comprises:

an adjusting screw disposed on said second shaft lever;

an adjusting screw stop surface disposed on a printing press side frame; and said adjusting screw stop surface is disposed substantially parallel to the at least one tangent.

15. The control device of claim 14, wherein:

said arrangement for moving said number switching device comprises a first pressure medium driven actuating cylinder;

said device for rotating said first eccentric bearing comprises a second pressure medium driven actuating cylinder;

said adjusting screw stop surface is dimensioned substantially the same as said eccentric path;

said adjusting screw stop surface is oriented parallel to said eccentric path;

said second end of said first shaft is disposed in said slidably mounted bearing; and said rotatable member is mounted on said first eccentric bearing.

16. A control device for a numbering and imprinting unit of a rotary printing press, which numbering and imprinting unit comprises: a numbering cylinder removably mounted in a printing press side frames; the numbering cylinder comprising at least one number printing element for printing successive numbers; an inking unit comprising a device for inking said at least one printing element and the inking unit being removable from the printing press; said control device comprising:

an arrangement for moving a numbering cylinder between a first position where a number cylinder is in engagement with an impression cylinder and a second position where a numbering cylinder is in disengagement from an impression cylinder;

said arrangement for moving a numbering cylinder comprising:

a first eccentric bearing disposed on a first end of a numbering cylinder;

a second eccentric bearing disposed on a second end of a numbering cylinder;

a device for rotating said first eccentric bearing;

a device for rotating said second eccentric bearing with a rotation of said first eccentric bearing;

a device for adjusting the position of engagement of a numbering cylinder with an impression cylinder;

said device for rotating said first eccentric bearing comprising a pressure medium driven actuating cylinder;

a device for switching a successive number printing element disposed on a numbering cylinder among successive numbers;

an arrangement for maintaining said successive number switching device in a substantially constant position relative to a numbering cylinder.

17. The control device of claim 16, wherein:

said device for rotating said second eccentric bearing comprises:

a first shaft for rotating said second eccentric bearing with said first eccentric bearing, said first shaft comprising a first end and a second end;

a first lever non-rotationally mounted on said first end of said first shaft;

said first lever extending radially outward from said first shaft;

a first connecting member disposed to connect said first eccentric bearing to said first lever;

a second lever non-rotationally mounted on said second end of said first shaft;

said second lever extending radially outward from said first shaft; and a second connecting member disposed to connect said second eccentric bearing to said second lever.

18. The control device of claim 17, wherein:

said adjusting device comprises an adjustable stop;

said numbering cylinder moving arrangement comprises a contact surface;

said contact surface is disposed on one of said first eccentric bearing and said second eccentric bearing;

said contact surface is disposed to contact said adjustable stop in the position of engagement of a numbering cylinder with an impression cylinder.

19. The control device of claim 18, wherein said arrangement for maintaining said number switching device in a substantially constant position relative to said numbering cylinder comprises:

a second shaft comprising a first end and a second end;

a third eccentric bearing disposed to mount said first end of said second shaft;

a fourth eccentric bearing disposed to mount said second end of said second shaft;

a first control lever disposed to connect said first eccentric bearing to said third eccentric bearing; and a second control lever disposed to connect said second eccentric bearing to said fourth eccentric bearing.

20. A control device for a numbering and imprinting unit of a rotary printing press, which numbering and imprinting unit comprises: a numbering cylinder comprising a first end and a second end; at least one number printing element being disposed on the numbering cylinder; the at least one number printing element comprising a device for printing successive numbers; said control device comprising:

a device for removably mounting a numbering cylinder in a printing press side frames;

said numbering cylinder mounting device comprising an arrangement for moving a numbering cylinder between a first position where a numbering cylinder is in engagement with an impression cylinder and a second position where a numbering cylinder is in disengagement from an impression cylinder;

said arrangement for moving a numbering cylinder comprising:

a first eccentric bearing disposed on a first end of a numbering cylinder;

a second eccentric bearing disposed on a second end of a numbering cylinder;

a device for rotating said first eccentric bearing;

a device for rotating said second eccentric bearing with a rotation of said first eccentric bearing; and a device for adjusting the position of engagement of a numbering cylinder with an impression cylinder;

a device for switching said successive number printing device among successive numbers; and an arrangement for maintaining said successive number switching device in a substantially constant position relative to a numbering cylinder.

* * * * *

UNITED STATES PATENT AND TRADEMARK OFFICE

CERTIFICATE OF CORRECTION

PATENT NO. : 5,662,038

DATED : September 2, 1997

INVENTOR(S) : Frank SCHAUM, Willi BECKER and Dr. JÜrgen RAUTERT

It is certified that error appears in the above-identified patent and that said Letters Patent is hereby corrected as shown below:

In column 2, line 19, after 'mounted', delete "6n" and insert --on--.

In column 11, line 17, after 'is' insert --described herein.--.

Signed and Sealed this

Tenth Day of March, 1998

*Attest:*

*Attesting Officer*

BRUCE LEHMAN

*Commissioner of Patents and Trademarks*